US008590221B1

(12) United States Patent
Pal, Jr.

(10) Patent No.: US 8,590,221 B1
(45) Date of Patent: Nov. 26, 2013

(54) METHOD FOR DRAINAGE OF WATER AROUND SUBTERRANEAN STRUCTURES

(76) Inventor: John Joseph Pal, Jr., Petersburg, KY (US)

( * ) Notice: Subject to any disclaimer, the term of this patent is extended or adjusted under 35 U.S.C. 154(b) by 0 days.

(21) Appl. No.: 13/507,949

(22) Filed: Aug. 9, 2012

(51) Int. Cl.
*E02D 19/00* (2006.01)

(52) U.S. Cl.
USPC ..... 52/169.5; 52/169.1; 52/302.1; 52/302.3; 52/302.6; 52/169.14; 405/42; 405/36

(58) Field of Classification Search
USPC ..... 52/169.5, 302.1, 302.3, 58, 60, 169.14, 52/169.1, 209, 302.7, 302.6, 205.54; 405/38, 37, 43, 45, 50, 42, 36; 220/6; 229/117.05, 117.07, 117.08
See application file for complete search history.

(56) References Cited

U.S. PATENT DOCUMENTS

| | | | | | |
|---|---|---|---|---|---|
| 1,734,777 | A * | 11/1929 | Pike | 52/169.5 |
| 4,943,185 | A * | 7/1990 | McGuckin et al. | 405/45 |
| 5,630,299 | A * | 5/1997 | Jackman et al. | 52/169.5 |
| 5,836,115 | A * | 11/1998 | Clay et al. | 52/169.5 |
| 5,845,456 | A * | 12/1998 | Read | 52/741.11 |
| 5,890,334 | A * | 4/1999 | Hughes, Jr. | 52/299 |
| 6,247,874 | B1 * | 6/2001 | Hu | 405/43 |
| 6,662,504 | B2 * | 12/2003 | Krogstad | 52/61 |
| 6,904,723 | B1 * | 6/2005 | Moore et al. | 52/169.5 |

* cited by examiner

*Primary Examiner* — Chi Q Nguyen

(57) ABSTRACT

This invention pertains to the drainage of water around subterranean structures and is a modular system of modular panels connected by double standing seams. The modular panels can be interconnected and drain water away from a foundation and can be connected to each other to extend endlessly the length and width of the modular panels.

2 Claims, 22 Drawing Sheets

METHOD FOR DRAINAGE OF WATER AROUND SUBTERRANEAN STRUCTURES

BACKGROUND OF THE INVENTION

The field of the invention is related to method for drainage of water around the subterranean structures. There are many ways currently on the market to drain water away from foundations; almost all of them are expensive.

For example, one could place a drainage pipe on the outside of a footer of a foundation wall. One such example is shown in Clay et al. U.S. Pat. No. 5,836,115. This patent provides a drain pipe on the outside of the footer (along with a liner that forms a drainage trench) which will evacuate the water. This is very extensive procedure involving expensive heavy machinery to excavate and backfill around the complete structure all the way to the bottom of the footer. Installing a perimeter drain pipe is an expensive way to drain the perimeter water from the outside of the wall especially when the drain is usually 6 to 8 feet below grade.

Another method of the drainage of foundation water is to place a similar drain pipe on the inside of the footer of a foundation wall. This usually involves jack hammering up the perimeter of the slab, hauling away all of the rubble, and placing a drainage pipe around the perimeter of the basement floor that will drain to a sump pit with a pump. This is also a very expensive and laborious procedure that involves skilled construction workers.

Another common method to stop water penetration of the foundation slab and wall is to install a wall membrane. One such example is shown in Sacks U.S. Pat. No. 5,826,390. This patent involves a wall membrane to drain water downward to a drain pipe away from the wall. Again, this method is very expensive and involves heavy machinery, skilled contractors, and a substantial cost.

There also have been some patents on drainage cells that either overlap or claim to be interlocking, but if a sealant in a joint fails or the interlocking mechanism is not manufactured to a certain tolerances, they will leak. An example is shown in Lee U.S. Pat. No. 6,736,569. This patent involves a drainage cell that fits together with a "male" and "female" connection. However, if the drainage cell is not manufactured to certain tolerances, water will find a way to leak thru the material.

Many homeowners put down some type of thick plastic to protect their foundations, but in time, many of the plants and weeds break penetrate the barrier they have placed under the soil, rendering the barrier useless.

BRIEF SUMMARY OF THE INVENTION

In view of the foregoing disadvantages of prior art, the general purpose of this present invention, which will be described subsequently in greater detail is to provide for inexpensive drainage of water that can penetrate a foundation wall and slab.

The present invention is comprised of subterranean modular panels that are interlocking by various means (including a double standing seam) to each other. The modular panels can be connected to a drainage pipe and the water collected by the drainage pipe can then be drained away from the structure or the water could be simply drained to a French drain in the ground distant from the wall, thereby protecting the foundation wall of a building from water.

The principal advantage of this invention is the double standing seam modular panel system which is one of the only ways that four modular panels can be connected together and will always be leak proof provided that the water can be drained off by gravity in a timely manner. With just a standard single standing seam joint, four exactly the same or modular panels can not be attached together to form a leak proof seal in a modular fashion.

Another advantage is that the modular panels are easy and inexpensive to install and can be manufactured cheaply. Expensive equipment and skilled contractors are not needed and most homeowners can install the modular panels themselves. The homeowners could easily dig out 8 inches or more below grade where the subterranean modular panels will be placed. At most, a homeowner may buy or rent an inexpensive garden tiller which could automatically break up the top 8 inches or more of soil, and simply lay the interlocking modular panels down and back fill on top of the modular panels.

Another advantage of the modular panels, is that they are made out of materials that are non-rusting (material could include plastic, including pvc, hdpe etc.) and are impermeable to tree and plant roots by the nature of the modular panel's hardness and thickness.

Another advantage of the modular panels is that they may be cut and are modular and may be connected to each other to extend endlessly the length and width of the modular panels.

Another advantage of the modular panels is you can just use them on one face of your building where water is a problem and you don't have to use them on all the other sides a structure as you sometimes do when you use drain pipe placed at the footer.

This invention can be used in a multitude of other situations not mentioned here.

DETAILED DESCRIPTION OF THE INVENTION

The drawings and description contained are for purposes of illustrating the invention only and not for purposes of limiting same.

Figure 1:
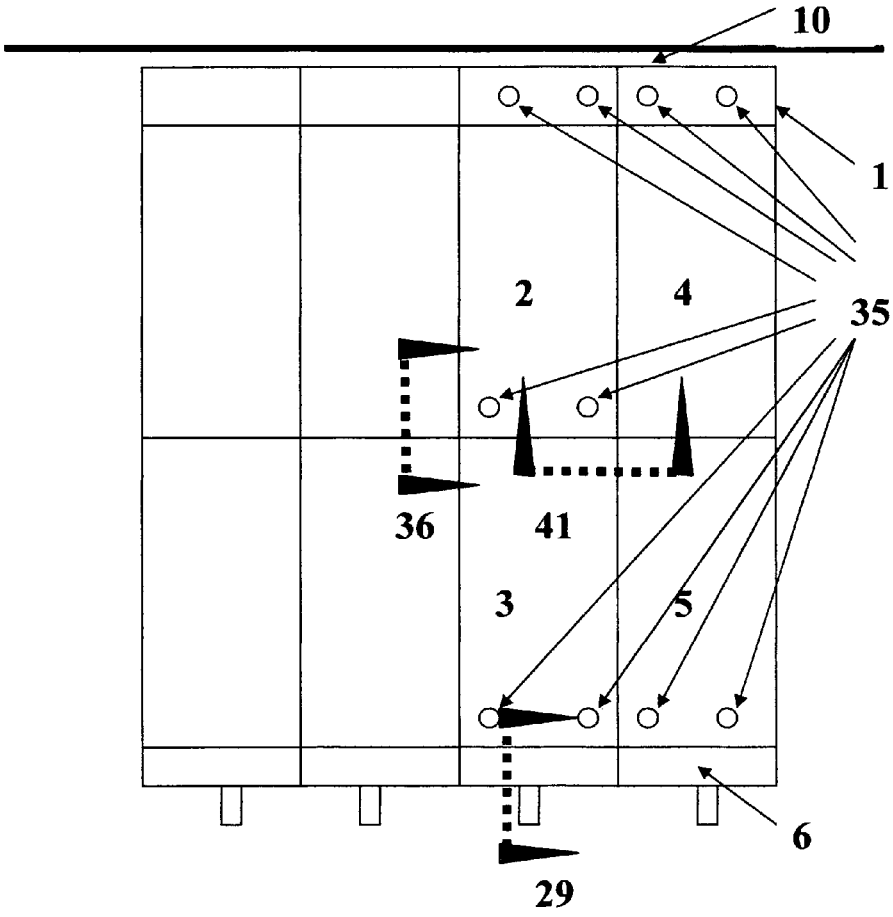
FIG. 1 sets forth a view in plan of the modular panels connected together with a wall or perpendicular modular panel attachment, the component to attach modular panels to a wall or to perpendicular modular panels, and an end drain, the component for remote drainage of water.
Figure 8:
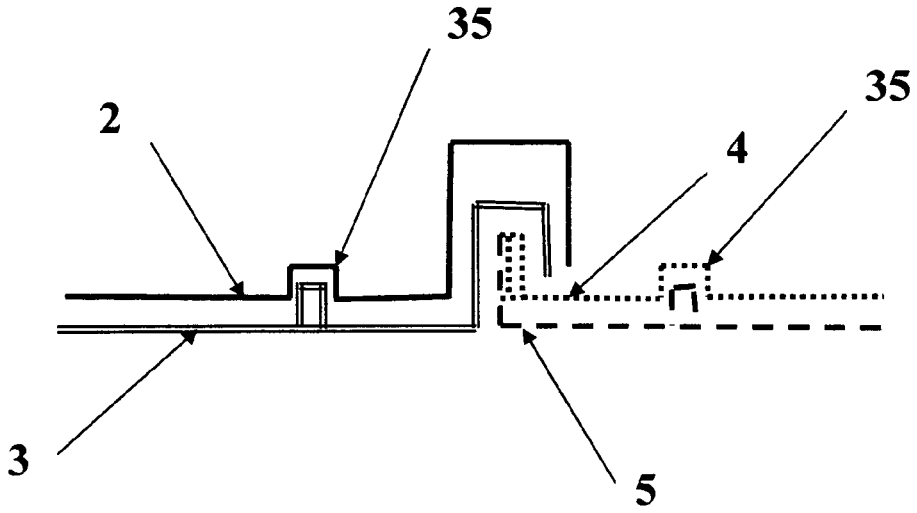
FIG. 8 sets forth a view in front elevation and more specifically one double standing seam joint between four modular panels connected together, that is two pairs of modular panels connected side by side and both pairs of modular panels connected to each other.
Figure 21:
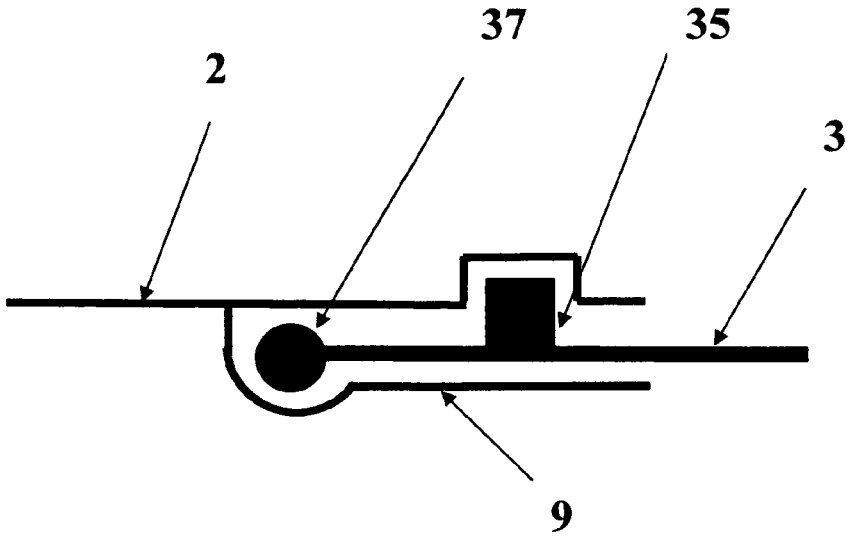
FIG. 21 sets forth a view of a cross section detail of how the modular panels will be connected together.

FIG. 1 shows a plan view of the modular panels with modular panels 2,3,4,5 connected together with the wall or perpendicular modular panel attachment 1, and the end drain 6. The raised knobs 35 that interconnect the modular panels together are shown. Number 36 indicates where the detail cross section in FIG. 21 is taken. Number 29 indicates where the cross sections in FIGS. 16,17,18,19 are taken. The wall of a typical house 10 is also shown. Number 41 indicates where the front elevation cross section in FIG. 8 is taken.

Figure 2:
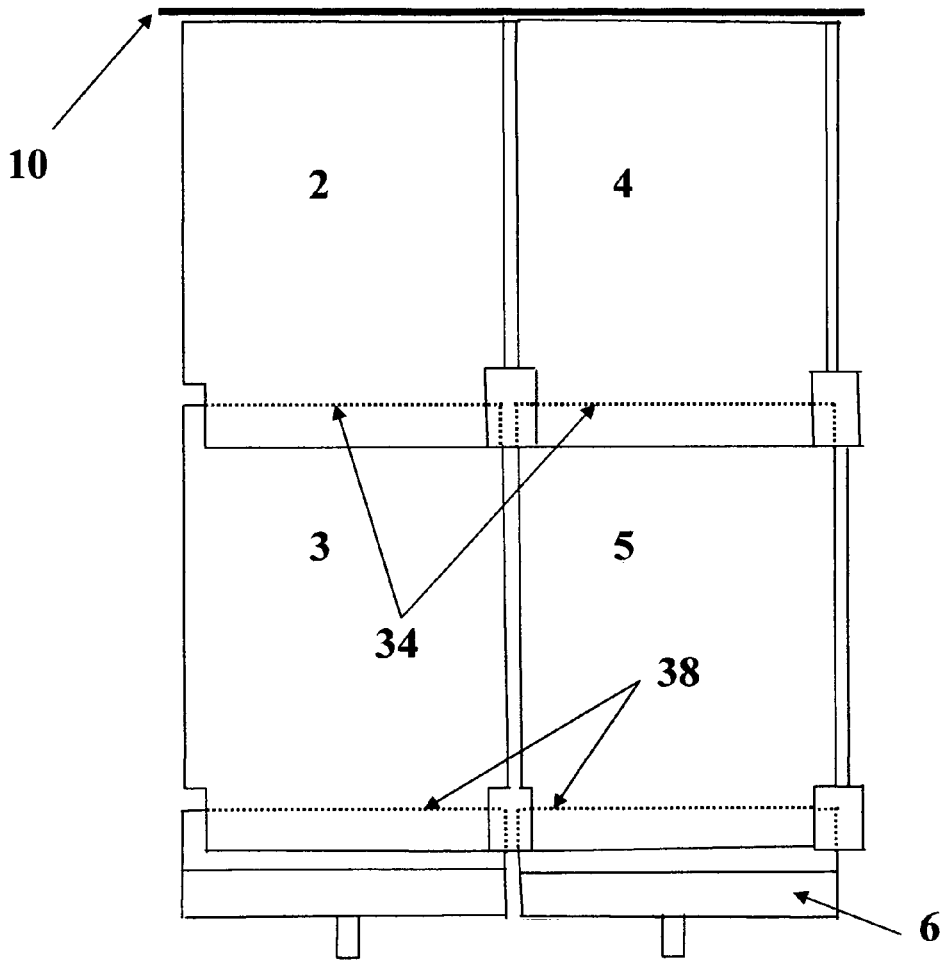
FIG. 2 sets forth a view in a detailed plan of four modular panels connected together with the end drain, the component for drainage of water.

FIG. 2 shows a detailed plan view of the modular panels with modular panels 2,3,4,5 connected together. Also shown are the end drain 6 and the wall of a typical house 10. Number 34 shows the dotted lines of modular panels 3 and 5 interlocking underneath modular panels 2 and 4. Number 38 shows the dotted lines of end drains 6 interlocking underneath modular panels 3 and 5. The wall or perpendicular modular panel attachment 1 as shown in FIG. 1 is not shown in FIG. 2.

Figure 3:
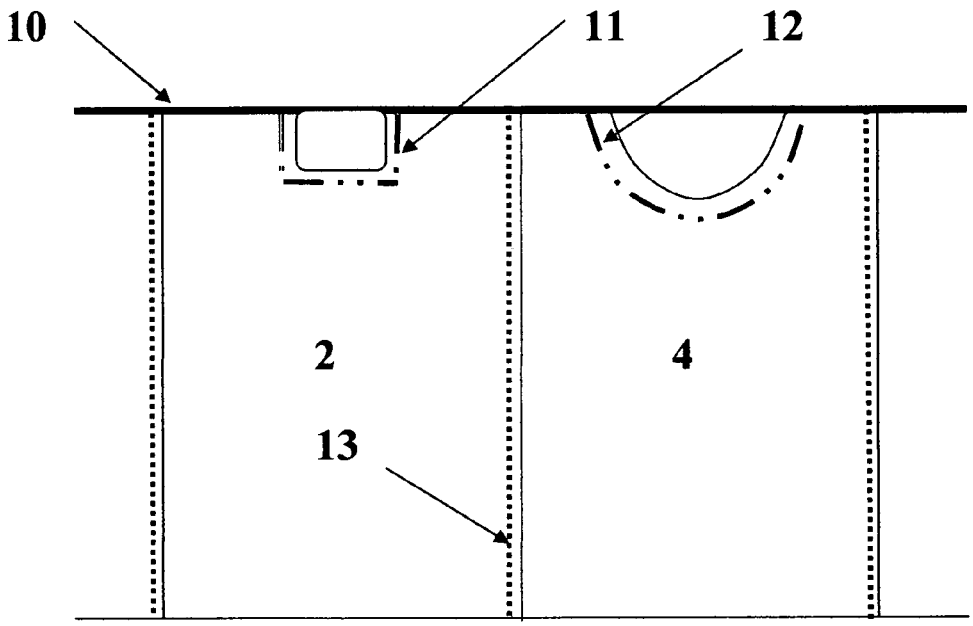
FIG. 3 sets forth a view in plan of an example of how to cut around a window well or a drain pipe.

FIG. 3 shows a plan of modular panel 2 cut out around a drainpipe 11 and modular panel 4 cut out around a window well 12. The dotted lines shown with number 13 indicate left modular panel edge of modular panel 4 that folds upward interlocking underneath with the double standing seam right side modular panel edge of modular panel 2. The wall of a typical house 10 is also shown.

Figure 4:
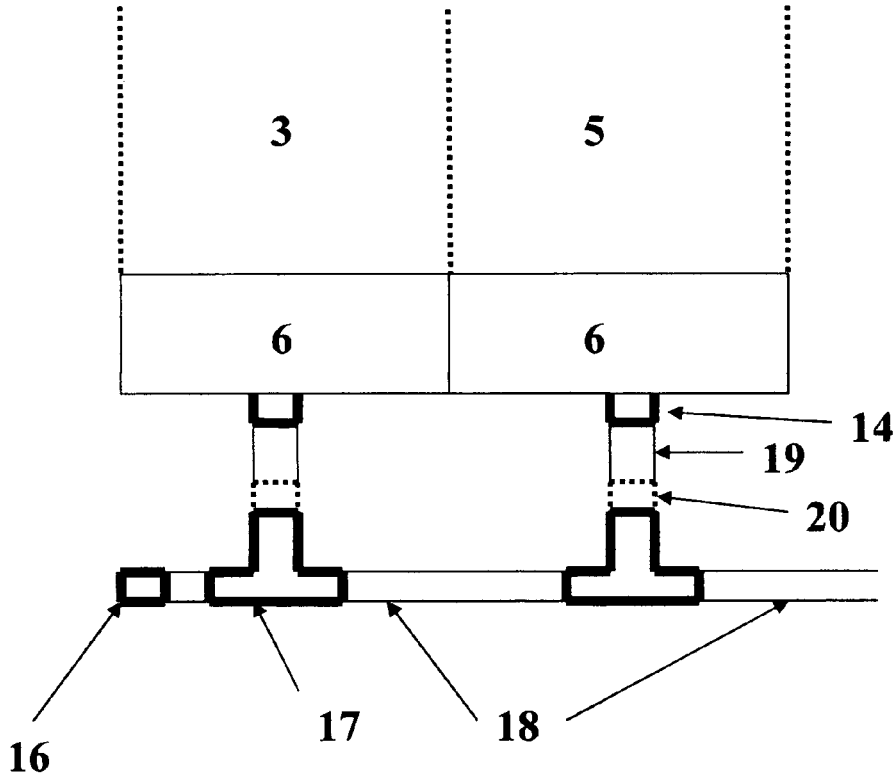
FIG. 4 sets forth a view in a plan of the end drain hose connection.

FIG. 4 shows a plan view of an end drain hose connection. FIG. 4 shows modular panels 3 and 5, along with end drains 6. The output pipe 14 is part of the end drain will connect to standard size pipe 19. Number 20 is an expander pipe that will connect the standard size pipe 19 to a larger standard size tee pipe 17. Number 16 is an end cap and number 18 is connector pipe.

Figure 5:
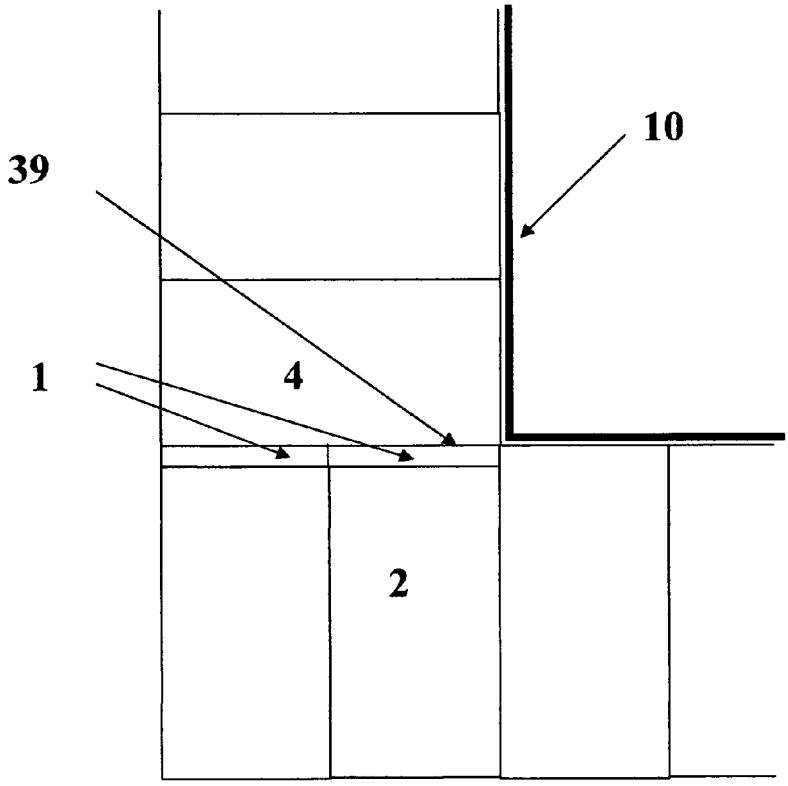
FIG. 5 sets forth a view in plan of an example of an outside corner.

FIG. 5 shows the plan of the modular panels around an outside corner of a house 10. Modular panels 2 and 4 are shown. Number 1 is a wall or perpendicular modular panel attachment that can be used to connect to a wall or can be used to attach to the double standing seam right side of a modular panel 4. Number 39 indicates where the perspective in FIG. 13 was taken at the right side of the modular panel 4 along the double standing seam.

Figure 6:
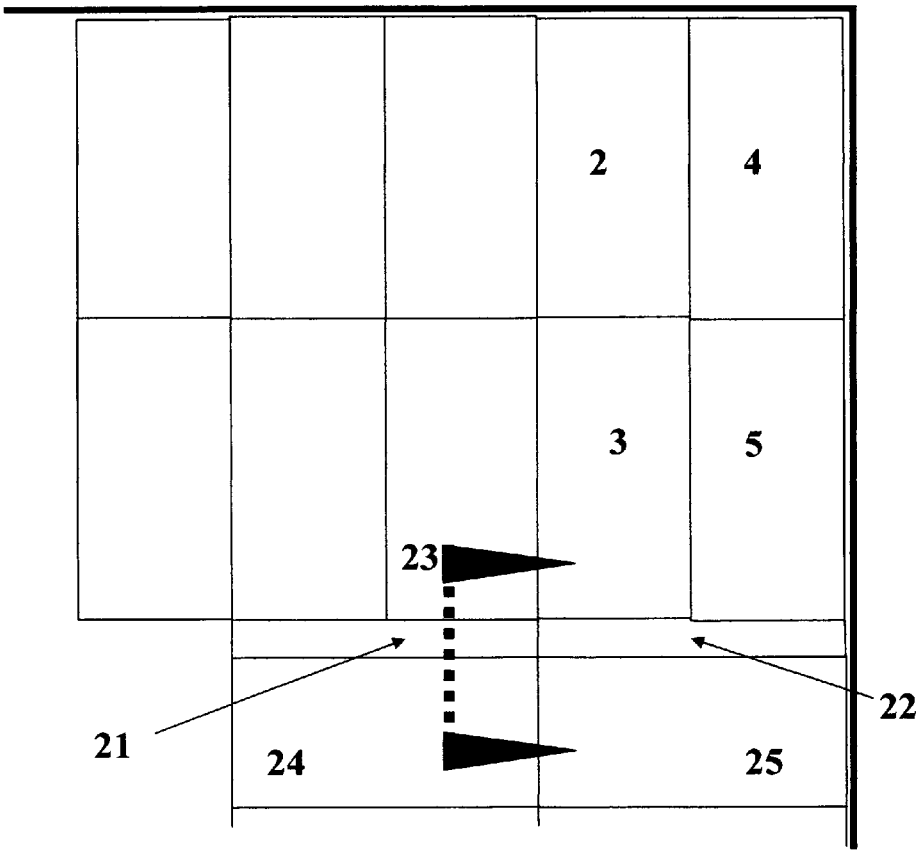
FIG. 6 sets forth a view in plan of an example of an inside corner with a gutter drain.
Figure 15:
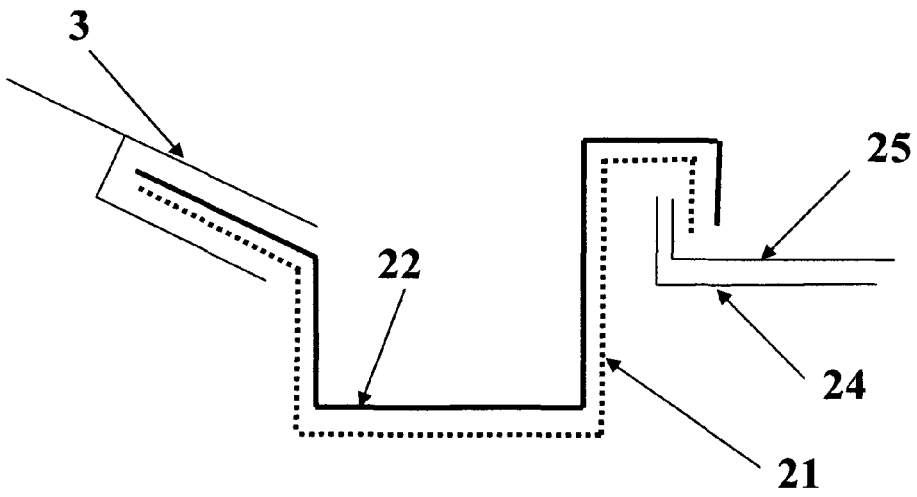
FIG. 15 sets forth a view in cross section of modular panels connected to the left gutter drain.

FIG. 6 shows the plan of the modular panels around an inside corner of a house. Modular panels 2,3,4,5 are shown. Modular panels 24, 25 are also shown. Numbers 21, 22 are gutter drains. Number 23 indicates where the cross section in FIG. 15 is taken.

Figure 7:
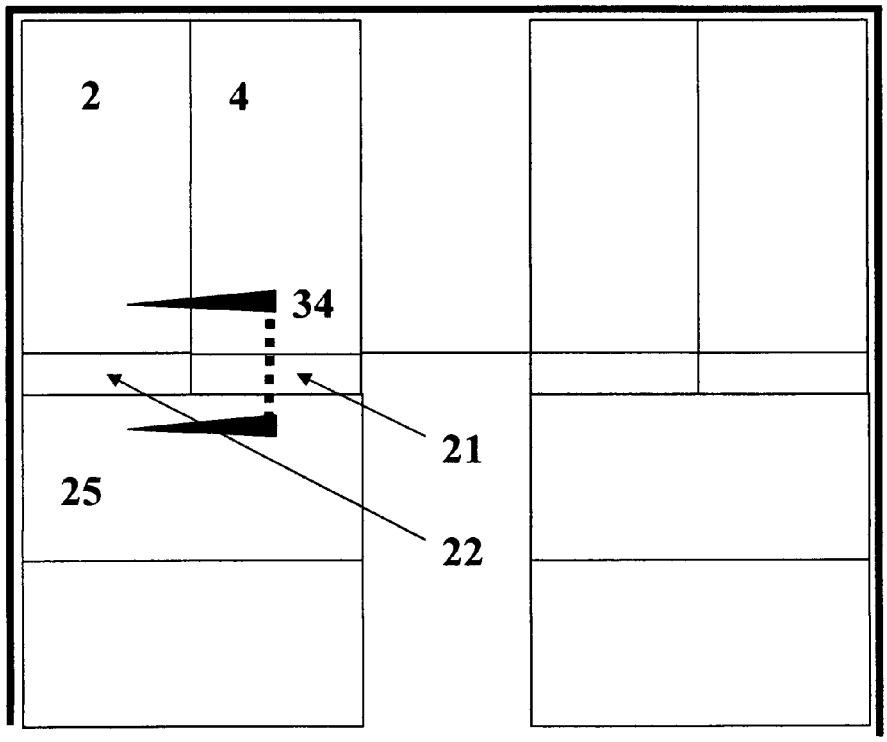
FIG. 7 sets forth a view in plan of an example of two inside corners with gutter drains.
Figure 14:
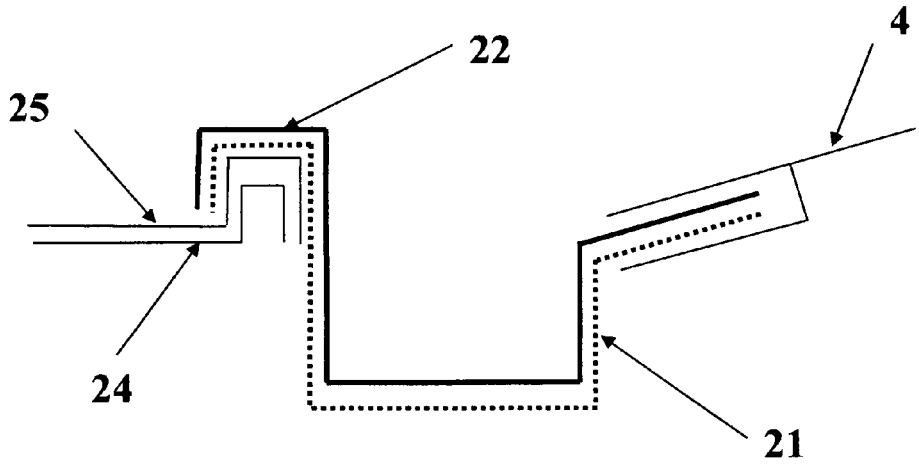
FIG. 14 sets forth a view in cross section of modular panels connected to the right gutter drain.

FIG. 7 shows the plan of the modular panels around two inside corners of a house. Modular panels 2, 4 are shown. Modular panel 25 is also shown. Numbers 21, 22 are gutter drains. Number 34 indicates where the cross section in FIG. 14 is taken.

FIG. 8 shows the front elevation cross section also indicated on FIG. 1 cross section marker number 41 of modular panels 2,3,4,5 when they are connected together. Number 35 indicates the raised knobs that interconnect the modular panels together.

Figure 9:
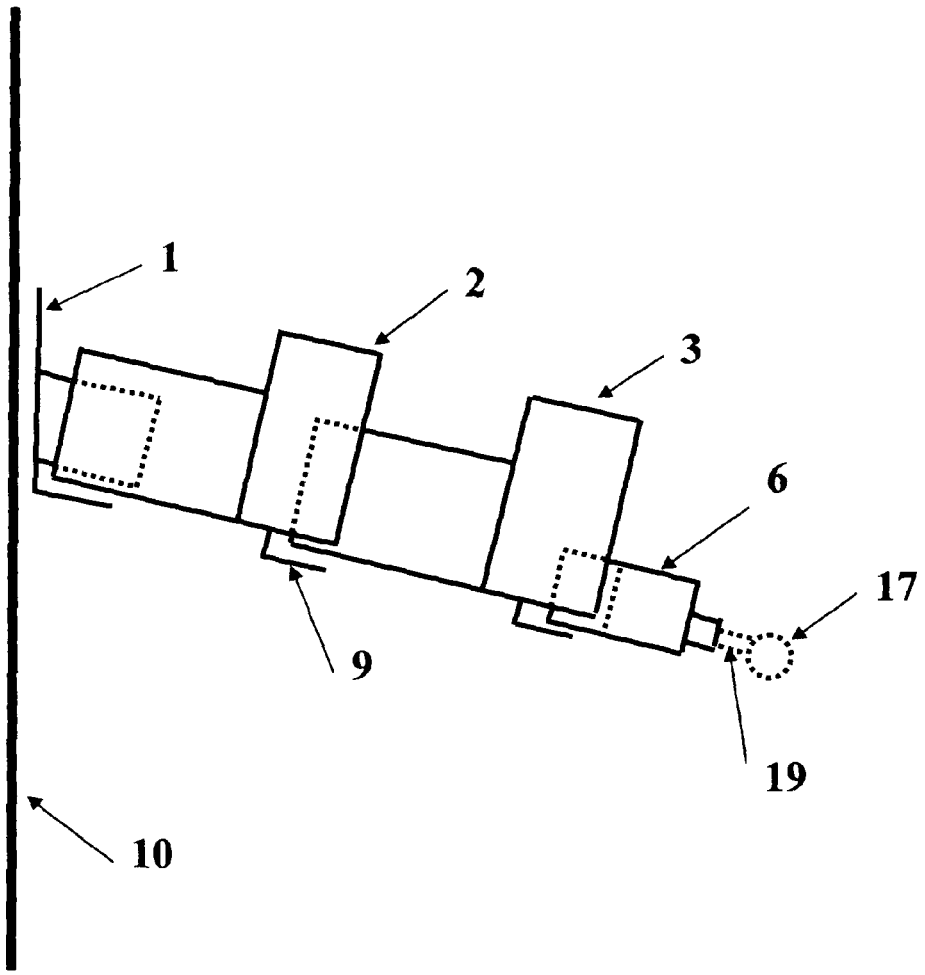
FIG. 9 sets forth a view of the side elevation of the modular panels connected together with wall or perpendicular modular panel attachment, the component to attach modular panels to a wall or to perpendicular modular panels, (this component is not shown on some of the drawings) and an end drain, the component for remote drainage of water.

FIG. 9 shows a left side elevation of two modular panels 2, 3 with a wall or perpendicular modular panel attachment 1 and a gutter drain 6. Number 10 indicates the wall of the house. Number 17 is the larger standard size tee pipe and number 19 is the standard size pipe. Number 9 is the flange that is under the modular panel that connects the modular panel 2 to the modular panel 3 directly below.

Figure 10:
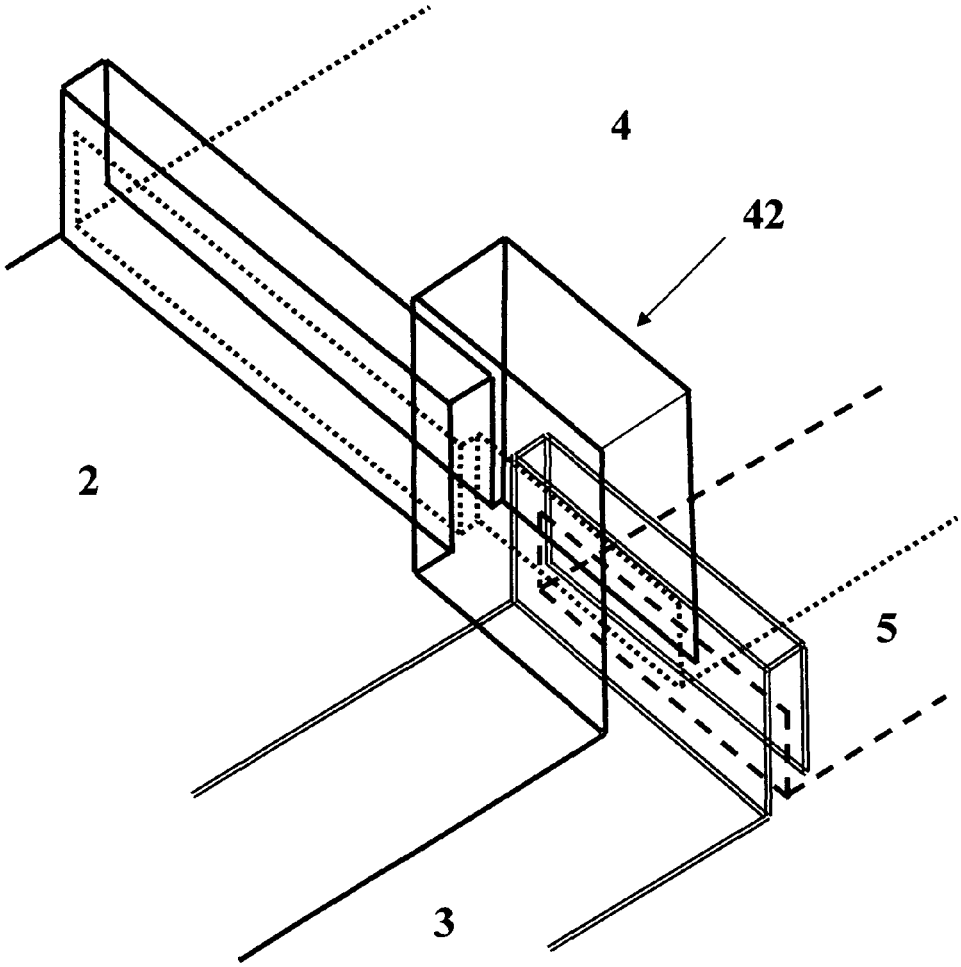
FIG. 10 sets forth a view in perspective of a double standing seam connection of four modular panels connected together.

FIG. 10 shows a perspective of an intersection of four modular panels 2,3,4,5. Number 2 modular panel has a solid line. Number 3 modular panel has a double solid line. Number 4 modular panel has a short dotted line. Number 5 modular panel has a long dashed line. Number 42 indicates the double standing seam connection allowing all four modular panels 2,3,4,5 to be connected together without penetration of water when the modular panels 2,3,4,5 are on a slope that is able to drain the water away.

Figure 11:
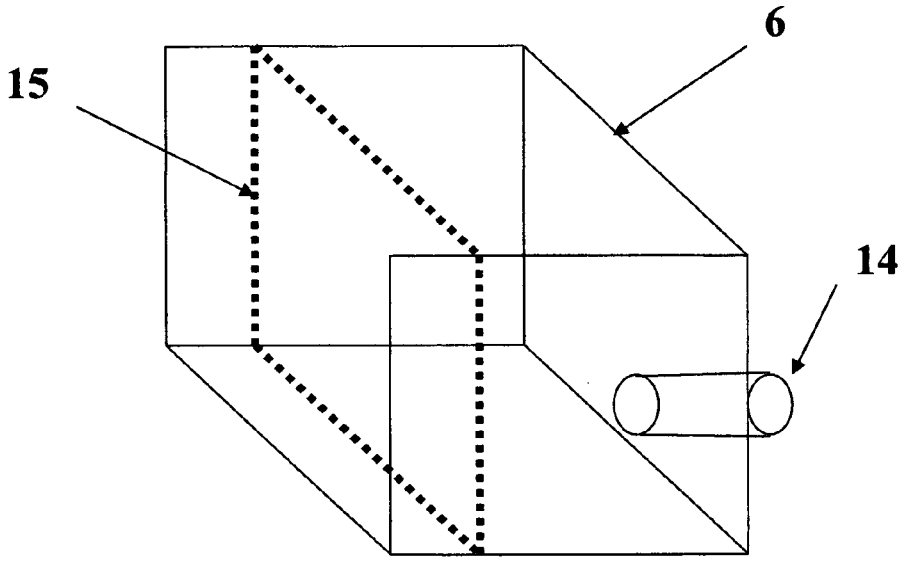
FIG. 11 sets forth a view in perspective (inside perspective) of the end drain, the component for drainage of water.

FIG. 11 shows an inside perspective of the end drain 6. The output pipe 14 is shown. Number 15 is the vertical filter for the end drain.

Figure 12:
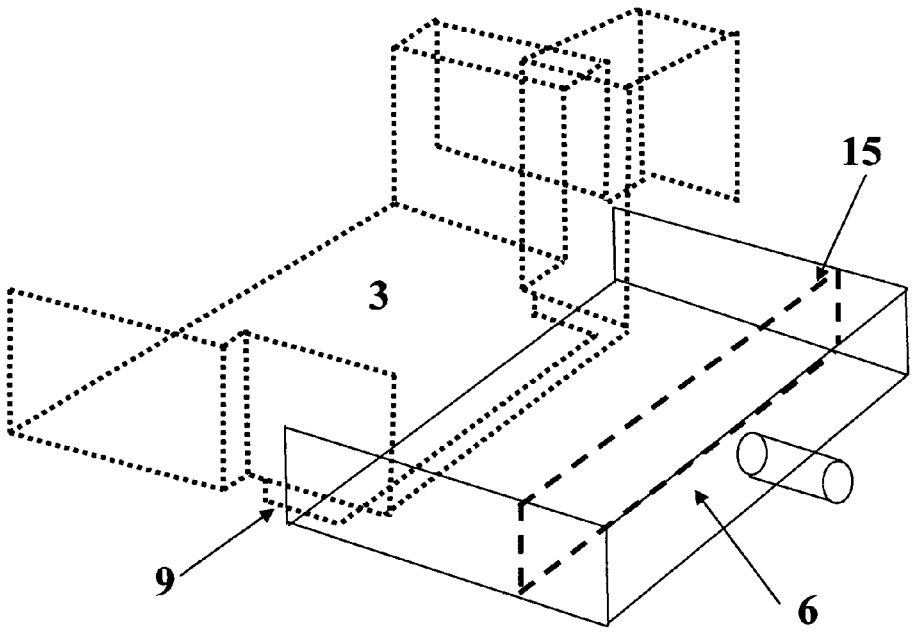
FIG. 12 set forth a view in perspective (outside perspective) of the end drain, the component for drainage of water.

FIG. 12 shows an outside perspective of the end drain 6 connected to a modular panel 3. Number 3 modular panel is shown in a dotted line. Number 3 modular panel's bottom flange is shown with number 9. Number 15 is the vertical filter for the end drain.

Figure 13:
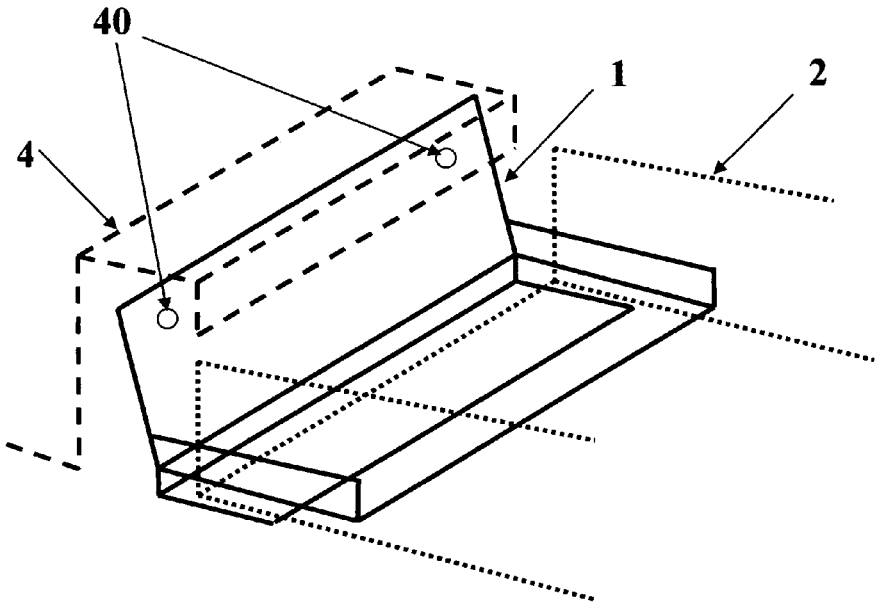
FIG. 13 sets forth a view in perspective of a modular panel connected to a wall or perpendicular modular panel attachment, the component that will attach the modular panel to walls or to modular panels that are perpendicular to the modular panel in an outside corner.

FIG. 13 shows a perspective how the wall or perpendicular modular panel attachment 1 would affix to a wall or how the wall or perpendicular modular panel attachment 1 would fit under the double standing seam right side of a modular panel 4 at an outside corner of a building as also shown in FIG. 5. The modular panel 2 is attached to the wall or perpendicular modular panel attachment 1. Number 40 are the holes in the wall or perpendicular modular panel attachment 1 where the wall or perpendicular modular panel attachment 1 could be affixed to a wall.

FIG. 14 shows a cross section of a right handed gutter drain with the double standing seam right side of parallel modular panels 24,25 on the left side of gutter drains 21,22. Modular panel 25 is higher in elevation than modular panel 24. On the right hand side is the perpendicular modular panel 4. This cross section of a similar right handed gutter drain is illustrated in plan on FIG. 7 number 34, with the exception that modular panel 24 (which would have been lower than modular panel 25) is not shown in plan. Gutter drain 22 is higher in elevation and overlaps gutter drain 21.

FIG. 15 shows a cross section of a left handed gutter drain with the 90 degree vertical left side of parallel modular panels 24, 25 on the right side of gutter drains 21, 22. Modular panel 25 is higher in elevation than modular panel 24. On the left hand side is the perpendicular modular panel 3. This cross section of a similar right handed gutter drain is illustrated in plan on FIG. 6 number 23. Gutter drain 22 is higher in elevation and overlaps gutter drain 21.

Figure 16:
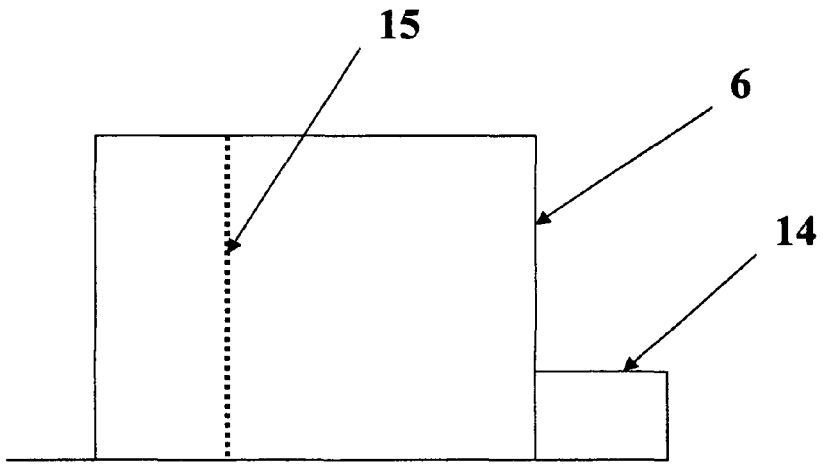
FIG. 16 sets forth a view in cross section of type one of an end drain that just has a vertical filter.

FIG. 16 shows a cross section of end drain type one that is also shown in the plan view of FIG. 1 number 29. The end drain 6 is shown with the output pipe 14. Number 15 is the vertical filter for the end drain.

Figure 17:
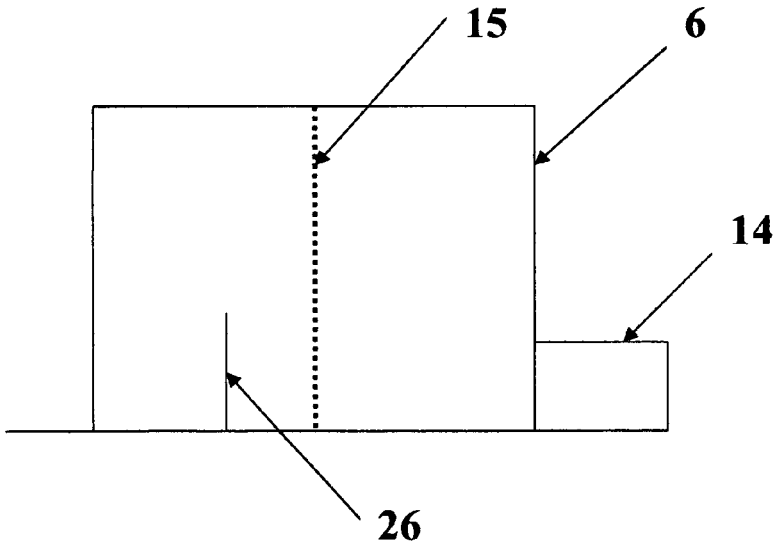
FIG. 17 sets forth a view in cross section of type two of an end drain that has a vertical filter, and a barrier.

FIG. 17 shows a cross section of end drain type two that is also shown in the plan view of FIG. 1 number 29. The end drain 6 is shown with the output pipe 14. Number 26 is a barrier to prevent debris from clogging up the vertical filter 15 in the end drain.

Figure 18:
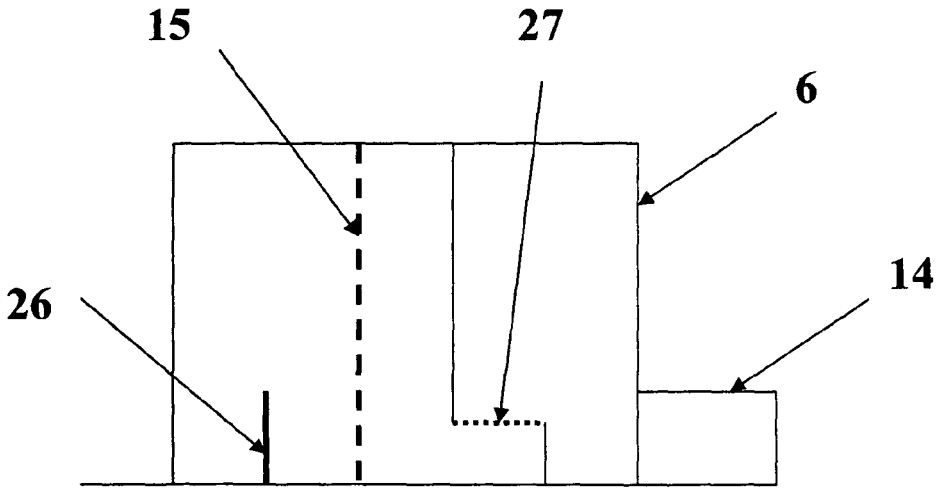
FIG. 18 sets forth a view in cross section of type three of an end drain that has a vertical filter, a barrier, and a horizontal filter.

FIG. 18 shows a cross section of end drain type three that is also shown in the plan view of FIG. 1 number 29. The end drain 6 is shown with the output pipe 14. Number 26 is a barrier to prevent debris from clogging up the vertical filter 15 in the end drain. Number 27 is an elevated horizontal filter to block particles from entering the output pipe 14.

Figure 19:
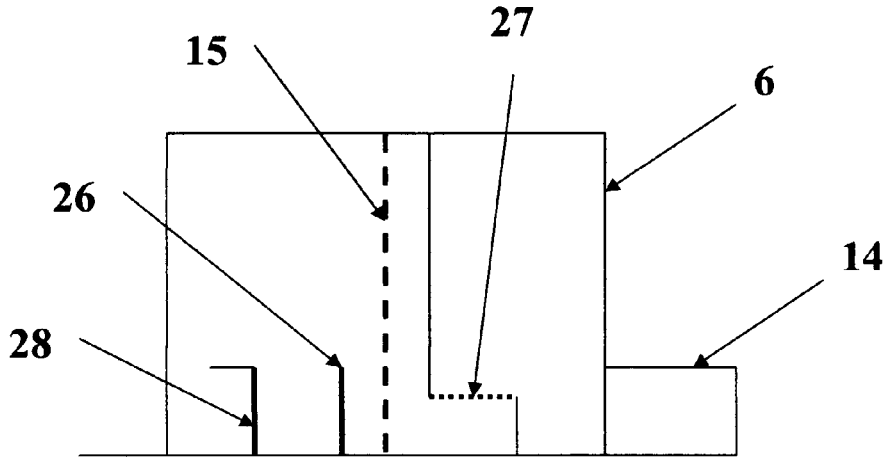
FIG. 19 sets forth a view in cross section of type four of an end drain that has a filer, a barrier, a horizontal filter, and a settlement area.

FIG. 19 shows a cross section of end drain type four that is also shown in the plan view of FIG. 1 number 29. The end drain 6 is shown with the output pipe 14. Number 26 is a barrier to prevent debris from clogging up the vertical filter 15 for the end drain. Number 27 is an elevated horizontal filter to block particles from entering the output pipe 14. Number 28 is another barrier that forms a settling area for particles along with barrier 26.

Figure 20:
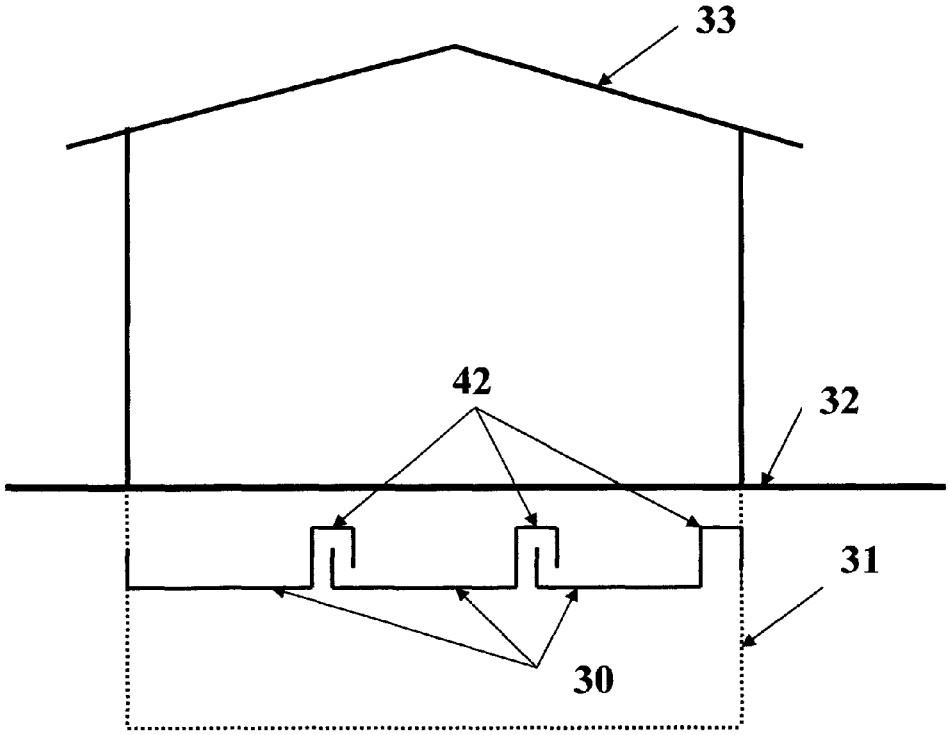
FIG. 20 sets forth a view in elevation of the modular panels on a typical house.

FIG. 20 shows a house elevation with a row of modular panels 30 each with their double standing seam 42 buried below the ground 32. Number 31 is the foundation wall of the house and number 33 is the outline of the roof.

FIG. 21 is a detailed cross section of the modular panel connection which is also indicated in plan in FIG. 1 number 29. The modular panels 2 and 3 are joined by both a flange 9 and a raised knob 35. Number 37 shows a rounded top edge of a modular panel so that the modular panel 3 will lock into the flange 9 of modular panel 2.

Figure 22:
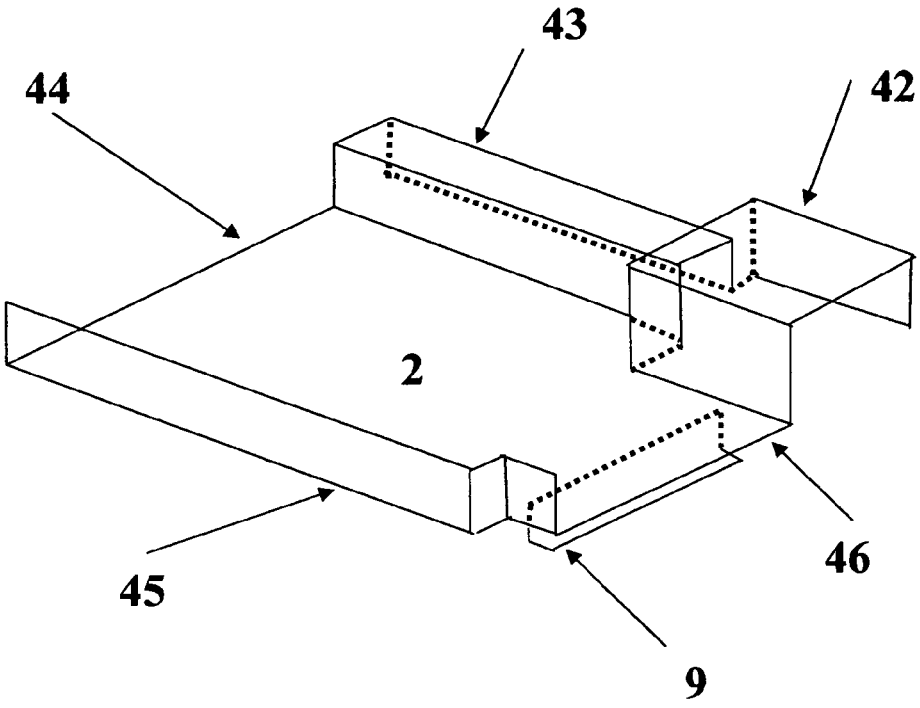
FIG. 22 sets forth a view in perspective of a modular panel.

FIG. 22 is a perspective of a modular panel 2. Number 9 indicates the flange. Number 42 indicates the double standing seam which is on the right side of modular panel 2. Number 43 indicates the right side of the modular panel 2 and also indicates the single standing seam which is along most of the edge of the right side. Number 44 indicates the top of the modular panel 2. Number 45 indicates the left side of the modular panel 2. Number 46 indicates the bottom of the modular panel 2; and wherein the modular panel 2 can be connected to other modular panels by any manner of connecting means that including gluing, clipping panels together, fastening with a nut and a bolt, use of said flanges, male and female connectors or any other means of connecting modular panels together.

What is claimed is:

1. A drainage system comprising: a modular panel having a planar base; a first sidewall and a second sidewall; wherein said first sidewall upwardly and perpendicularly extending from said base and said modular panel comprises a first end and a second end; the first end further including an L-shaped flange integrally forming with the first end; wherein said second sidewall upwardly and perpendicularly extending from said base; a first flange outwardly extending from said second sidewall; a second flange downwardly extending from said first flange; wherein the system further comprises a double standing seam overlapping at least a portion of said second sidewall, the first and the second flanges; said double standing seam and said L-shaped flange are continuously formed and connected to each other at the first end; and the system further comprising a single standing seam supporting the first end from a bottom side of the modular panel.

2. The drainage system according to claim 1, wherein said modular panel can be connected to other modular panels by any manner of connecting means that including gluing, clipping panels together, fastening with a nut and a bolt, use of said flanges, male and female connectors or any other means of connecting modular panels together.

* * * * *